United States Patent [19]

Soos

[11] 4,138,183

[45] Feb. 6, 1979

[54] CRYOGENIC CONNECTOR

[75] Inventor: William B. Soos, Woodland Hills, Calif.

[73] Assignee: G&H Technology, Inc., Santa Monica, Calif.

[21] Appl. No.: 697,916

[22] Filed: Jun. 21, 1976

[51] Int. Cl.[2] ..... H01R 13/52

[52] U.S. Cl. ..... 339/94 M; 339/30

[58] Field of Search ..... 339/60, 94, 64, 30; 174/50.61, 50.63, 15 CA, 15 S, 77 R

[56] References Cited

U.S. PATENT DOCUMENTS

| | | | |
|---|---|---|---|
| 2,658,183 | 11/1953 | Klostermann et al. | 339/64 M |
| 2,933,712 | 4/1960 | Klopfenstein | 339/94 M |
| 3,266,006 | 8/1966 | Abbott | 339/60 M |
| 3,441,898 | 4/1969 | Nodfelt | 339/60 M |
| 3,489,984 | 1/1970 | Bailey | 339/30 |
| 3,576,517 | 4/1971 | Johnson et al. | 339/94 R |
| 3,721,943 | 3/1973 | Curr | 339/94 M |

FOREIGN PATENT DOCUMENTS

| | | | |
|---|---|---|---|
| 851354 | 10/1966 | United Kingdom | 339/60 R |

*Primary Examiner*—Joseph H. McGlynn

*Attorney, Agent, or Firm*—Anthony W. Karambelas

[57] ABSTRACT

A cryogenic electrical connector including an elastomeric seal member for use between selected temperatures such as plus 250 degrees F. through minus 452 degrees F. wherein a change in the elastic state of the seal member at a cryogenic temperature to an inelastic state is compensated by the seal member to maintain a desired seal with respect to materials having substantially different coefficients of thermal expansion as compared to the coefficient of expansion of the material of the seal member.

8 Claims, 8 Drawing Figures

CRYOGENIC CONNECTOR

BACKGROUND

Electrical cable connectors of the type shown in U.S. Pat. No. 3,848,950 are often used in environments in which cryogenic temperatures may prevail, for example temperatures as low as minus 452 degrees F.. In such a cryogenic temperature range the physical and chemical characteristics of materials often change. A material having elastic properties at ambient temperatures may acquire inelastic properties at minus 250 degrees F. and retain such inelastic characteristics for temperatures therebelow. When such material become inelastic it may become brittle and its internal structure changed so that application of tensile forces of low order to the material will cause the material to break and fracture. The characteristics of such material in an elastic state may include capability of withstanding compressive forces without desctruction of the material.

Prior proposed electrical cable connectors of the type mentioned above have included an elastomeric seal member of solid disc form provided with a plurality of spaced holes for holding and passing metal electrical contact pins. At least a portion of the surfaces of such a disc is seated against inner chamber surfaces of a shell housing which contains the disc and contact pins and is arranged to mate with a companion electrical connector plug. In such prior proposed connector constructions, difficulty was encountered in maintaining a seal at the contact pins and at shell sealing surfaces when the connector was subjected to cryogenic temperatures. When such prior proposed connectors were subjected to stringent test standards involving subjecting the connector to numerous cycles of temperatures in and out of the cryogenic temperature range, the seals were destroyed because of the thermal shock encountered during such cycling.

SUMMARY

The present invention relates to an electrical connector including an elastomeric seal member which is constructed and arranged to maintain a desired seal relationship with other adjacent members after the material of the seal member has been subjected to cryogenic temperatures and has become inelastic.

The present invention contemplates a novel connector construction which includes material of widely different coefficients of expansion and different behavior at ambient and cryogenic temperatures, such construction being, for example, an electrical coupling or connector in which an elastomeric seal member is operably arranged between materials of different coefficients of thermal expansion. The invention also contemplates a method of providing a seal between elastomeric and other members wherein the seal is effectively operable during ambient and cryogenic temperatures even though the physical characteristics of one of the members might drastically change.

The primary object of this invention is to provide a novel construction and method of maintaining an effective operable relationship between two or more members of different material and of different coefficients of thermal expansion when the construction is subjected to a wide change in temperature including cryogenic temperatures.

An object of the invention is to provide a novel construction including a noncompressible elastomeric material and another different material wherein the elastomeric material is not subjected to tensile forces which might cause fractures or cracks in the material at cryogenic temperatures and which will maintain a seal relationship with the other material.

Another object of the invention is to provide a cryogenic seal means wherein a seal member has a first dimensional configuration in its elastic state and a reduced second configuration in its inelastic state, the first configuration being sufficient, in relation to the dimensional configuration of a cooperable material at a temperature producing said inelastic state, to prevent tensile forces of an order greater than the ultimate tensile force at the selected cryogenic temperature from being applied to the inelastic material.

A further object of the invention is to provide a method of providing a seal at cryogenic temperatures between a first material and a second material wherein the first material is sized to a first shape and the second material is sized to a second shape, the second shape being selected with reference to the differences in coefficient cf thermal expansion of said materials and whereby when one material becomes virtually inelastic, that material will not be subjected to forces exceeding the elastic limit of the one material at a selected cryogenic temperature.

Still further objects of the invention are to provide such an electrical connector for use at cryogenic temperatures wherein the seal member is maintained under selected compressive forces in one direction, and also to provide a sleeve member of dielectric material utilized to minimize electrical leakage along certain paths between connector components.

A specific object of the invention is to provide an electrical connector for use under cryogenic conditions, the connector including a receptacle section having a receptacle shell and a plug section having plug shell receivable within the receptacle shell, a coupling means carried by the plug section for releasably connecting the receptacle and plug sections wherein the plug shell carries a plug insert member having through-holes for electrical connectors, each hole having a outwardly flaring recess providing a relatively hard surface against which a boss on an elastomeric seal member carried by the receptacle shell engages in a circular line of sealing contact, such circular line seal being maintained under compression in selected cryogenic temperature ranges. Spring means are provided on the plug section for maintaining such compression at the circular seal line. The elastomeric seal member of non-compressible material is sized or structured so that through-holes provided in the seal member for pin contacts will fit about the pin contacts at selected cryogenic temperature ranges and tensile forces imparted to the elastomeric seal member at cryogenic temperature ranges will be below the elastic limit of the elastomeric material at such cryogenic temperature ranges whereby fracture or cracking of the elastomeric material at cryogenic temperature ranges will be eliminated.

Various objects and advantages of the invention will be readily apparent from the following description of the drawings wherein an exemplary embodiment of the invention is shown.

DRAWING

DESCRIPTION

Figure 1:
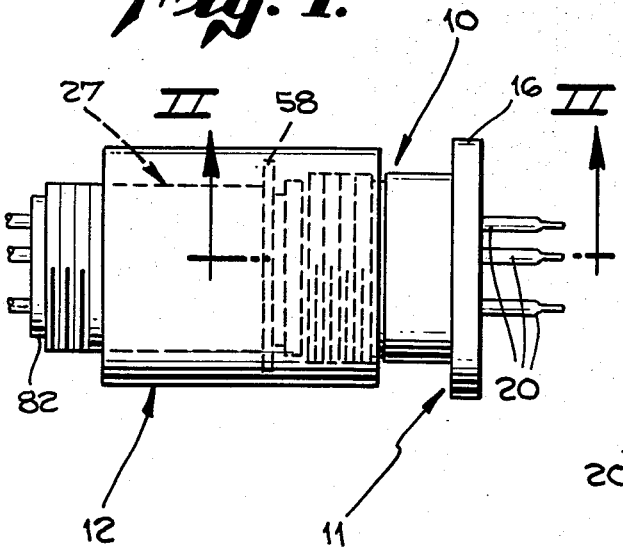
FIG. 1 is a side elevational view of an exemplary electrical connector embodying the invention.

In FIG. 1 there is shown an electrical connector generally indicated at 10 which may comprise a receptacle means or section 11 and a plug section 12 indicated in phantom lines. Generally, electrical connector 10 may be of a type shown in U.S. Pat. No. 3,848,950, owned by a common assignee. Such electrical connectors are constructed and arranged to electrically interconnect a plurality of cables for operation over a wide range of temperatures including cryogenic temperatures. Electrical interconnection of the plurality of cables is made through the engagement of pin and socket contacts carried by the two sections of the connector 10. It will be understood that various types of pin and socket contacts are known and have been proposed, it is the purpose of the present invention to provide in such an electrical connector a seal member which will remain functional at cryogenic temperature ranges and particularly at extremely low cryogenic temperature ranges where physical and chemical characteristics of the material of the seal member may change from an elastic to an inelastic state.

The receptacle section 11 is exemplary and is adapted to mate with a plug section such as 12 wherein socket contacts are positioned in registered alignment with the pin contacts and the two sections are brought together and mated so that electric continuity can be provided through the electrical connector. Various arrangements of receptacle and plug sections may be used.

Figure 2:
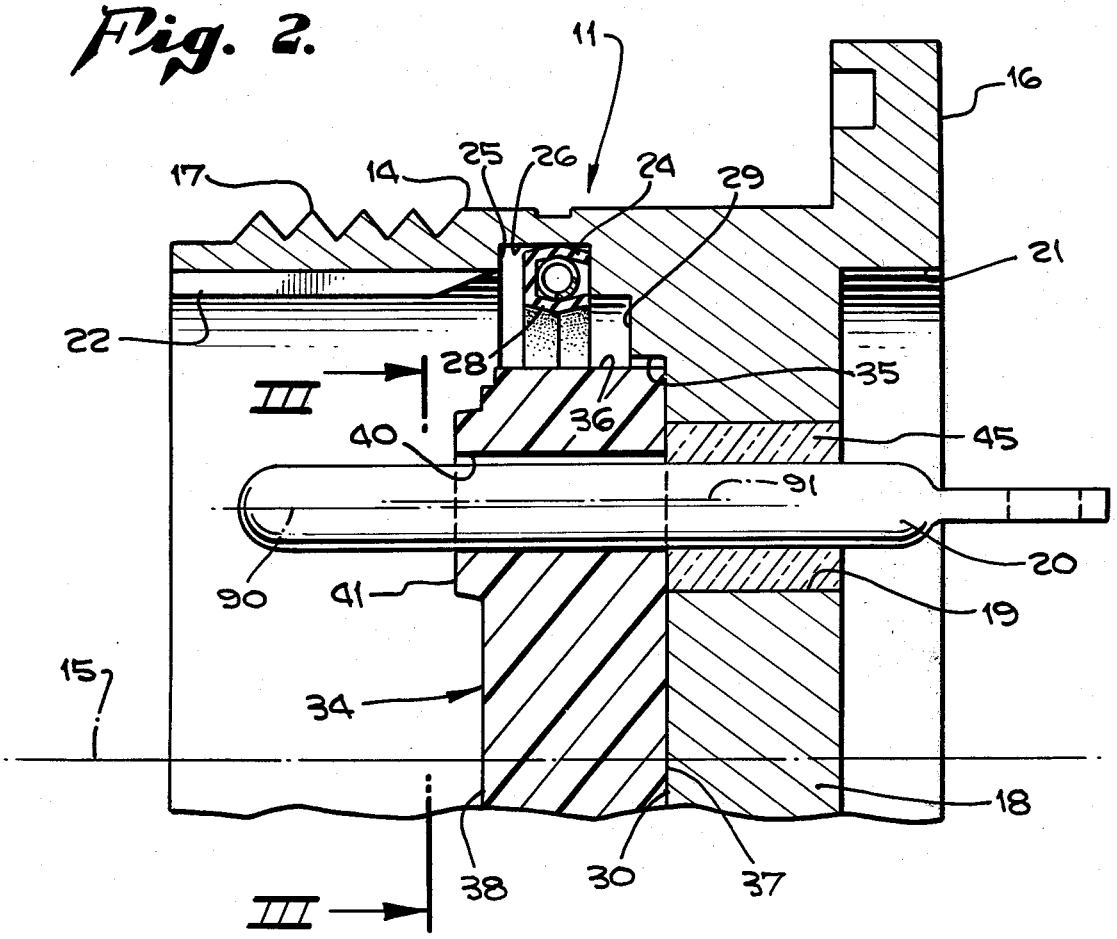
FIG. 2 is an enlarged sectional view of the receptacle shown in FIG. 1, the section being taken along a radial plane passing through the axis of the receptacle, the section illustrating a seal member, receptacle shell, and contact pin at an ambient temperature with the seal member in an elastic state.

In the exemplary embodiment of this invention the receptacle section 11 (FIG. 2) may comprise a cylindrical wall 14 having an axis 15. At one end of the cylindrical wall 14 a radially outwardly extending circumferential flange 16 provides a suitable attachment means for mounting the connector 10 or for associating the connector 10 with another electrical fitting. At the other end of cylindrical wall 14 and on the external surface thereof there are provided external threads 17 adapted to cooperate with the plug section 12 for connecting the two sections together.

Integral with cylindrical wall 14 is a transverse partition wall 18 which is provided with a plurality of selectively spaced through openings 19 through which extend a plurality of pin contacts 20. The transverse partition 18 defines with the flanged end of the wall 14 a circular, rather shallow recess 21 which may accommodate an associated electrical fitting to connect, cover, and/or protect the otherwise exposed ends of the contacts 20.

The partition wall 18 also defines with the other end of the cylindrical wall 14 a cylindrical chamber 22 into which may be received the electrical socket contact portion of plug section 12 for mating with the ends of pin contacts 20 which project into the chamber 20. When the plug section is inserted into chamber 22, a portion of the plug section may contact and bear against a circumferential seal means 24 carried in an annular groove 25 formed in the internal surface of cylindrical wall 14 at about its midportion and spaced axially from partition wall 18. Annular groove 25 provides a cylindrical seal surface 26 for the outer wall of seal 24. When the receptacle and plug sections are mated in full electrical and mechanical arrangement the seal means 24 provides a seal against surface 26 of the annular groove 25. The inner wall 28 of seal 24 bears in sealing relation against a circumferential portion of a cylindrical plug shell 27 of plug section 12 which extends within the chamber 22 and into close proximity with annular shoulder 29 formed on the partition wall 18. The annular shoulder 29 is spaced axially from groove 25 and from circular planar surface 30 of partition wall 18 which faces chamber 22.

It will be understood that the specific construction of the receptacle section 11, described above, may be varied, it being noted that circular surface 30 of the partition wall provides a seating surface for a seal member generally indicated at 34 and that the intermediate step shoulder 29 defines also a cylindrical internal surface 35 forming a recess within which is received a portion of the seal member 34.

The receptacle and plug sections 11 and 12 may be made of a suitable material depending upon the particular uses and environment in which the electrical connector is to operate, in this example, the receptacle section 11 may be made of stainless steel. The metal sections may also be made of carbon steel, selected aluminum alloys, or other suitable types of metal depending upon the environmental usage of the connector.

Seal member 34 may be made of an elastomeric material such as butyl rubber, EPR, and in this particular example a silicone rubber. Such materials are characterized by their non-compressability, that is, when placed under compression the material of the seal member 34 will flow and seek to occupy adjacent spaces, filling such spaces, and excluding therefrom any foreign substances such as unwanted gases or liquids. The presence of such unwanted fluids in the electrical connector at environmental operating ranges may result in harmful injury to electrical contact surfaces and may ultimately destroy the electrical conductivity to the connector.

Elastomeric seal member 34, in this example comprises a circular solid disk or receptacle insert body member having an outer cylindrical surface 36, a planar circular back surface 37 adapted to seat on surface 30 on partition wall 18 and a front surface 38 parallel to back surface 37.

Extending through disk 34 are a plurality of circularly spaced holes 40 adapted to receive therethrough pin contacts 20. In this example five holes 40 are shown, it is understood that holes 40 may be arranged differently and may include twenty or more holes depending upon the requirements of the electrical connector. At the forward face 38 of the disk 34, the entrance to each hole 40 is defined with a slightly frusto-conical boss 41 which is adapted to be received within an outwardly flaring or conical shaped recess 42 provided in a plug insert body member 43 provided on the mating plug section 12. The boss and recess arrangement at the interface of the seal members 34 and 43 provide a circular line S of sealing contact between edge 41*a* of the boss and the surface 42*a* of the conical recess 42. Member 43 may be of a hard plastic material different than that of member 34, and may be constructed with holes 40*a* corresponding in arrangement to holes 40 and containing electrical contact members 20*a* for engagement with pin contacts 20.

Each pin contact 20 is secured in partition wall 18 by a suitable well known dielectric seal and bonding means 45, such as a glass seal. Pin contacts 20 may be made of a selected electrical conducting metal such as copper, iron nickel, or a moly steel alloy. When a copper pin contact is used an Inconel collar may be interposed between the copper pin contact and the glass annulus which is between the Inconel collar and the metal of partition wall 18.

Figures 4, 5:
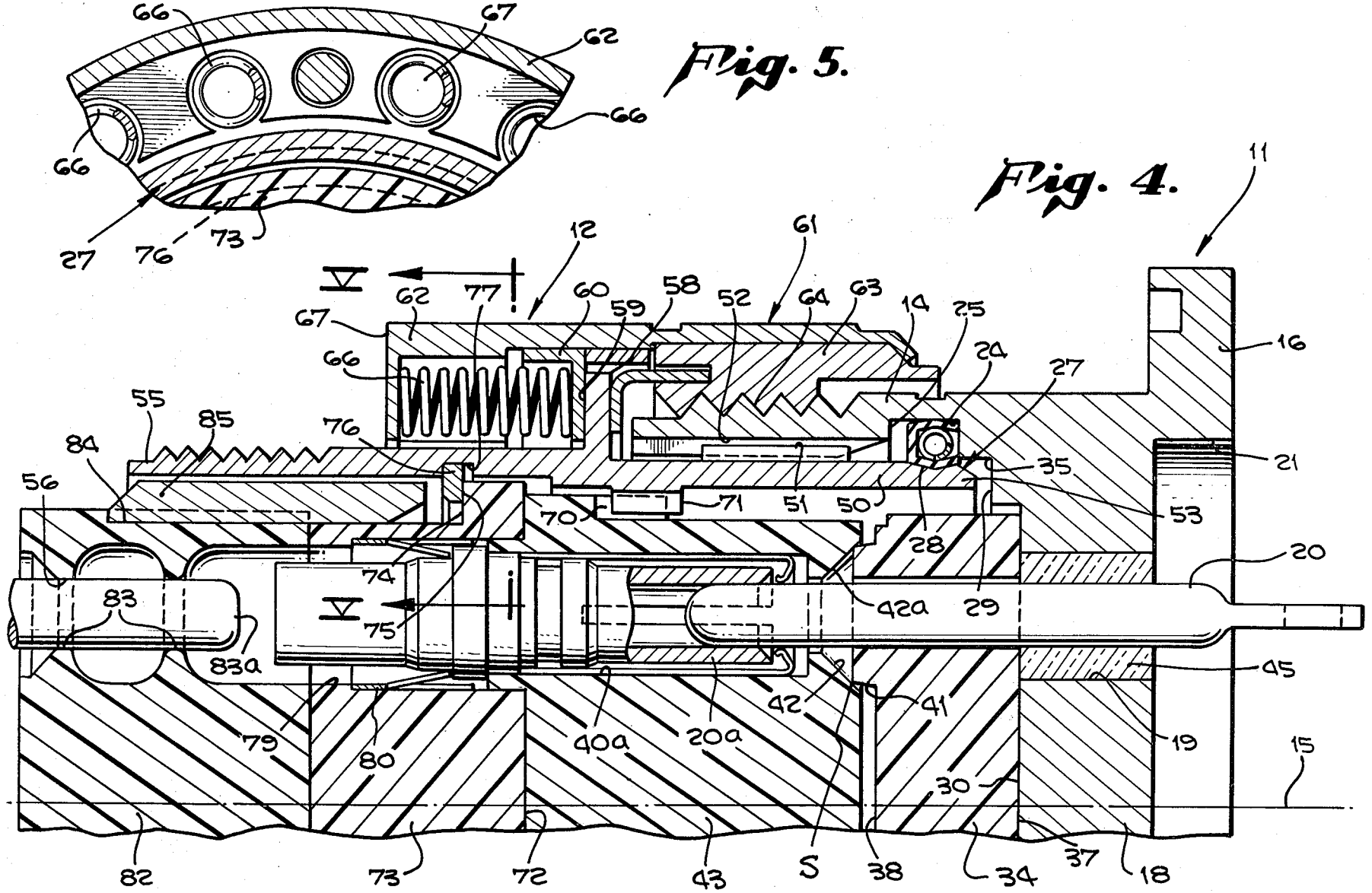
FIG. 4 is a fragmentary enlarged sectional view of the connector taken in the same radial plane as the sectional view of FIG. 2, the seal member being illustrated in an elastic state.
FIG. 5 is a fragmentary sectional view taken in the plane indicated by line V — V of FIG. 4.
Figure 6:
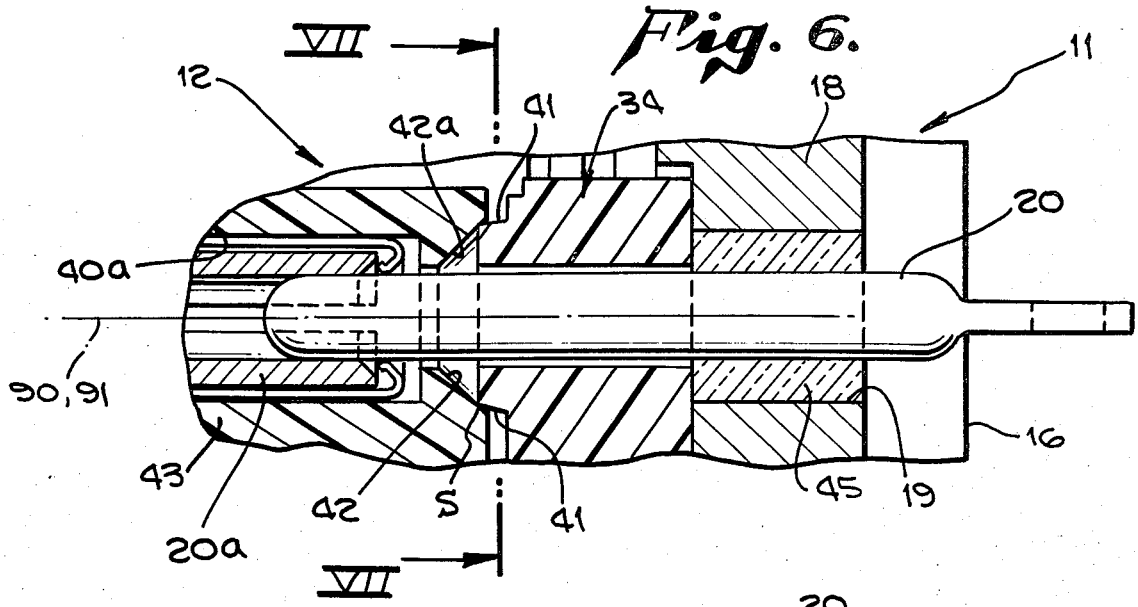
FIG. 6 is an enlarged fragmentary sectional view taken in the same plane as FIG. 4 and showing the seal members and pin contacts at cryogenic temperatures.

Plug section 12 (FIG. 4) includes cylindrical plug shell 27 having end portion 50 and movable along axis 15 of the connector into receptacle shell 14. The outer cylindrical surface of end portion 50 is provided with a key 51 engaged with an internal keyway 52 in receptacle shell 14 for longitudinal and non-rotational alignment of the plug and receptacle shells. The end extremely 53 of end portion 50 has beveled edges to facilitate engagement of end extremity 53 with seal 24 and to compress said seal 24 in sealing relation between the plug and receptacle shells.

Opposite end portion 55 of plug shell 27 may be provided with external threads for threaded connection with a connector and housing (not shown) adapted to carry contact plus receivable within grommet holes 56 aligned with openings 40*a* and contact pins 20. At the central portion of plug shell 27 a radially outwardly extending flange 58 provides an annular surface 59 against which may be seated an annular flanged spring seat member 60.

Coupling means 61 for interconnecting the plug and receptacle sections may comprise a coupling housing 62 connected with a coupling nut 63 which has threaded engagement at 64 with external threads provided on receptacle shell 14.

Means for imparting axially directed compression forces through the plug section to seal member 34 on the receptacle section includes a plurality of circumferentially spaced coil compression springs 66 having spring ends seated against spring seat member 60 and seated at their opposite spring ends against a radially inwardly directed flange 67 on coupling housing 62. When coupling means 61 is rotated relative to the receptacle section 11 in threaded engagement at 64, it will be apparent that the circularly arranged springs 66 exert a circumferential uniformly axially directed force toward the receptacle section 11 and to the plug section 27 through flange 58 against which spring member 60 is seated.

The plug shell 27 carries therewithin seal member 43 of relatively hard plastic dielectric material (such as Rockwell ASTM D785), said seal member 43 having an external keyway 70 to receive an internal key 71 on plug shell 27. Seal member 43 may be bonded at 72 to an insert body member 73 of dielectric material, said body member 73 having an annular shoulder 74 for axially directed thrust engagement at 75 by an annular thrust ring 76 carried in an internal annular groove 77 provided in plug shell 27. Body member 73 includes holes 79 corresponding to and in alignment with holes 40*a* in seal member 43 and adapted to receive electrical contact retainer means 80 provided therein for contact socket member 20*a*.

Bonded to body member 73 may be a grommet seal member 82 provided with holes 56 having spaced internal annular ribs 83 for pressure engagement with an electrical wire 83*a* which extends therethrough into electrical contact with the contact socket member 20*a*. The outer circumference of grommet seal member 82 is provided with an interference fit at 84 with an elongated dielectric cylindrical sleeve member 85 which extends upon adjacent outer surfaces of member 73 and serves to inhibit electrical leakage from the electrical contact areas end portion 55 of metal shell plug shell 27.

Insertion of an electrical wire 83*a* into hole 56 causes spreading and stretching of the grommet seal material and imparting tensile forces to the material. Sleeve member 85 restricts spreading of the grommet material and thereby limits such tensile forces. Ribs 83 are thus urged or held in tight annular sealing engagement with an inserted contact pin.

When coupling means 61 is rotated to draw the plug and receptacle sections into full mated and locked position, the springs 66 maintain the assembly of the members 73, 43 and 34 under compression in an axial direction. The amount of axial compressive forces imparted to elastomeric seal member 34 are sufficient to cause member 34 to be under compression at the cryogenic temperature range for which the electrical connector is intended to operate and thus the circle line seals of the bosses 41 with the conical recesses 42 are maintained at such cryogenic temperature ranges.

A detailed description of the preservation of a seal at cryogenic temperatures and the avoidance of fractures or line cracks in seal member 34 is now given.

Figure 7:
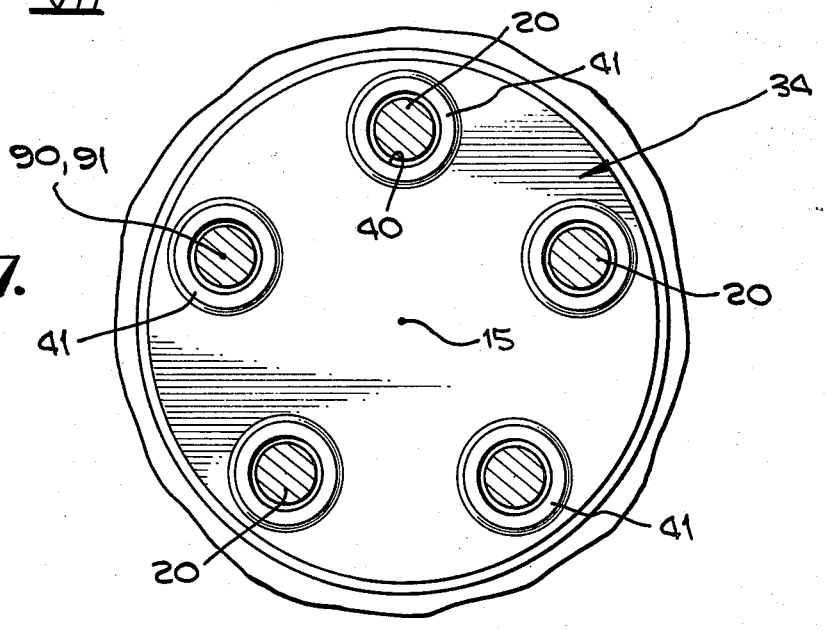
FIG. 7 is a fragmentary sectional view taken in the plane indicated by line VII — VII of FIG. 6.
Figure 8:
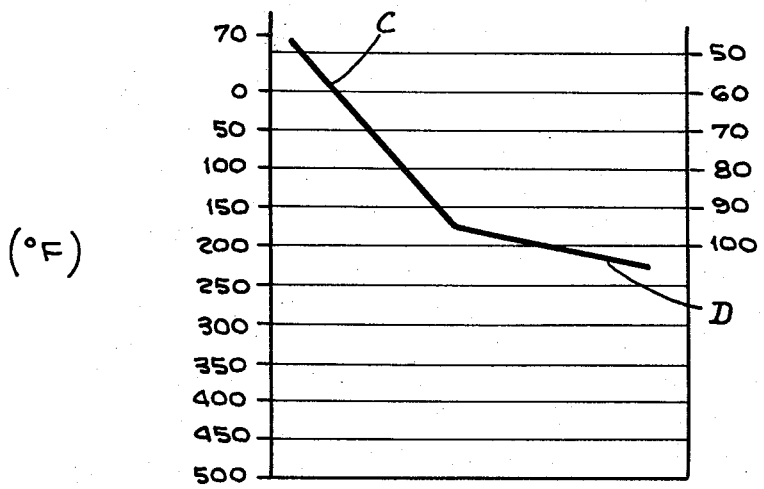
FIG. 8 is a chart indicating linear characteristics of the coefficient of expansion of an exemplary seal member during its elastic state and into the cryogenic temperature range and in relation to the hardness and brittleness of the material as indicated by the Durometer Shore "A" scale.

Elastomeric seal member 34 of this example is a silicone rubber material. As shown in FIG. 7 such a silicone rubber material is characterised by virtual noncompressability and by flow of rubber when placed under compression along one or more axes. Flow of rubber occurs during the elastic condition of the silicone rubber. In addition, such a silicone rubber has a coefficient of thermal expansion of $45 \times 10^{-5}$ inch per inch per degree Farenheit. In FIG. 7 there is shown on one scale, degrees F. from plus 70 degrees F. to minus 450 degrees F. An opposed Durometer Shore A scale shows hardness of the silicone rubber from 50 to 100 in respect to the temperature range to which the material may be subjected. It will be noted from FIG. 7 the thermal expansion or contraction of the material is virtually linear as represented by the straight sloping line C. It will be noted that the slope of line C is uniform between about −200 degrees F. to about 70 degrees F. In the cryogenic temperature range, the elastic state of the silicone rubber material undergoes a change to a virtually inelastic state.

In its inelastic state the silicone rubber material has a generally linear thermal coefficient of expansion or contraction as indicated by line D, the slope of which is quite shallow as compared to the slope of line C. Thus, it will be noted that between about −170 degrees F. to −225 degrees F. the change in Durometer reading shows hardness of the material varies from about 95 to 100. At such a Durometer reading the silicone rubber material, in its virtually inelastic state, is quite brittle and readily fracturable in the event the material is subject to tensile forces, which may be very low but which may exceed the elastic limit of the material at a cryogenic temperature.

In this example of this invention the stainless steel material forming the shell may have a coefficient of thermal expansion of $0.8 \times 10^{-5}$ inches per inch per degree F. A substantial difference in coefficients of thermal expansion occurs between the silicone rubber, and the stainless steel material. At cryogenic temperature ranges it will be apparent that the differences in expansion and contraction could produce tensile forces acting upon the silicone rubber which when the silicone rubber was in its inelastic condition, would cause cracking or fracture of the then brittle material.

Figure 3:
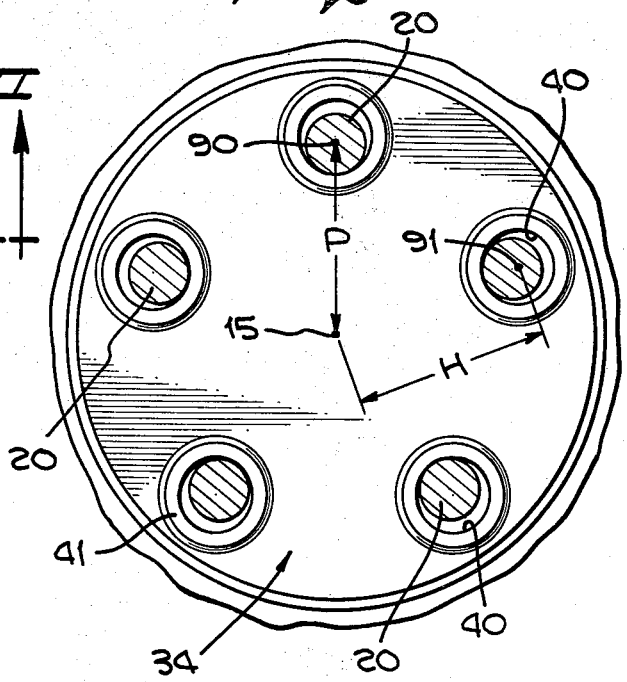
FIG. 3 is a fragmentary transverse sectional view taken in a plane indicated by line III — III of FIG. 2.

The novel construction of the present electrical connector includes the spacing of the axis 90 of each pin contact 20 a predetermined radial distance P from axis 15 of the connector 10, axis 15 being common to the plug and receptacle sections 11 and 12 and to seal member 34. At ambient temperatures, that is, at for example 70 degrees F., axis 91 of hole 40 is spaced radially outwardly of the axis 90 of the pin contact. The diameter of each hole 40 is larger at ambient temperatures than the diameter of pin contacts 20. Also, the difference in the radius P and in radius H (between the axis 15 and the axis 91 of the hole) is constructed to be, in this example, in the order of 6% oversize. In such ambient condition it should be noted that the illustration in FIG. 3 is somewhat exaggerated to show the oversized holes 40. The pin contacts 20 are provided with a loose sliding fit in holes 40.

When the connector sections 11 and 12 are brought into fully mated condition seal member 34 is placed under compression in an axial direction, that is, along axis 15 by springs 66. The silicone rubber material flows and moves laterally of axis 15 and occupies more of the space radially outwardly of member 34. The recesses 42 on mating seal member 43 in plug section 12 are in pressure abutment with the circular edges 41*a* of seal member 34. Thus, in fully mated condition, seal member 34 is under compression in the axial direction and some portions may be under tension because of the flow of the material.

As illustrated in FIG. 7, as the connector is subject to lower temperature ranges, the elastic characteristic of the silicone rubber decreases and the rubber becomes more brittle. As the cryogenic temperature reaches between −150 degrees F. and −200 degrees F., there is relative contraction between the seal member 34, the pin contacts 20, the receptacle shell 14, and seal member 43. The construction of seal member 34 in an oversize relation in an ambient temperature and the significant differences or mismatch between the coefficients of thermal expansion of the silicone rubber and other materials is such that when the temperature reaches the point where the silicone rubber material changes from an elastic state to an inelastic state the contraction of the seal member 34 will move the material thereof radially inward, that is, towards connector axis 15 so that the axes 90 and 91 of the pin contact and the hole respectively become coaxial or coincident. The exaggerated diameter of the hole 40 shown in FIG. 3 is diminished so that hole 40 at the temperature mentioned is symmetrical with the pin contact and affords a sliding fit therewith. It will be noticed that as the silicone rubber material and the material of the other connector parts contract in accordance with their coefficient of thermal expansion, any tensile forces acting on seal members 34 are reduced and are of a magnitude less than the elastic limit of the elastomeric material at the selected design cryogenic temperature. In the axial direction compressive forces exerted by springs 66 are lessened, but are sufficient to effectively maintain the circular line seal S of the bosses 41.

As noted in FIG. 7, the slope of the line D relates to the change in the brittleness of the silicone rubber material in its inelastic state. It will be apparent that as the cryogenic temperature range extends below −250 F. that the inelastic state of the material is subject to little change. The dimensional change of the silicone rubber material acting at such lower ranges of temperatures does not continue to any significant degree. Therefore, the material will not fracture, break, or shatter because of its extremely brittle condition. The seal member 34, at the cryogenic temperature range through the line D of the chart on FIG. 7, will dimensionally sufficiently correspond with the dimensional change in the other materials of the connector so that the seal member may perform its desired sealing function under adverse environmental conditions.

When the electrical connector 10 is subjected to cryogenic temperatures in which the seal member 34 is in its inelastic state the dimensional relationship between the seal member 34 and the adjacent parts of the shell and pin contacts is such that a desired fit is maintained between the several parts of the connector. In temperature ranges in which the silicone rubber material is in its elastic state, when the compressibility and flow characteristics of the silicone rubber material provide a seal member which effectively operates under a compressive condition.

The above description has been with respect to a specific example of materials, namely: a silicone rubber and a stainless steel shell for the receptacle. It will be understood that other materials may be employed in practicing the method and construction of this invention and said materials may have substantially different coefficients of expansion. The percentage of dimensional oversize that the seal member is provided and the determination of the condition of the material at the temperature in which it changes its character; that is, from an elastic to an inelastic state may also be different and is considered in determining the dimensional relationship of the elastomeric seal member and the initial shell.

Various changes and modifications may be made in the practice method and the construction of the electrical connector described above which may come within the spirit of this invention, and all such changes and modifications coming within the scope of the amendment claims or embraced thereby.

I claim:

1. In an electrical connector for use under cryogenic conditions and including a receptacle means having a receptacle shell and plug means having a plug shell receivable within the receptacle shell, a coupling means carried by the plug means for releasably connecting the receptacle shell and plug shell, the combination of:

a body member of relatively hard dielectric material within said plug shell, said body member having through holes for electrical contact elements, an outwardly flaring surface at one end of each hole;

a seal member of flowable elastomeric dielectric material within said receptacle shell, said seal member having through holes for containing contact pins, a projecting boss at one end of each hole in said seal member for cooperable circular sealing contact with said outwardly flaring surface of an opposed aligned hole in said body member;

spring means on said plug means operable to cause flow of and to place said elastomeric seal member under axially directed compression throughout the operating temperature range of the conductor to maintain said circular sealing contact;

said body member and seal member having a common axis;

the material of said body member, seal member, said contact pins having different coefficients of thermal expansion and contraction, said seal member being inelastic at a cryogenic temperature;

the diameters of the holes of said seal member and the distance of the axes of said holes from said common axis having oversize dimensions relative to said pins, the axes of said holes and pins received therein at ambient temperature being noncoincident and being coincident at cryogenic temperatures where said seal member is inelastic, tension forces acting on said seal member during change in temperature being thereby reduced and less than the elastic limit of said elastomeric material at such cryogenic temperature.

2. In a connector as stated in claim 1 wherein said oversized dimensions of said seal member at ambient temperature range is approximately 6% greater than the dimensional size of said seal member at a selected cryogenic temperature range.

3. In an electrical connector as stated in claim 1 wherein said elastomeric seal member is made of silicone rubber;

and the axes of said contact pin holes in said seal member are radially outwardly offset from axes of contact pins in said holes at ambient temperature.

4. In an electrical connector as stated in claim 3 wherein said contact pin holes in said elastomeric seal member have internal diameters about 6% greater than the diameter of said contact pins.

5. A cryogenic seal means for an electrical connector having a shell of a first material and a seal member therein of a second material, said materials having different coefficients of thermal expansion, said second material being inelastic at a certain cryogenic temperature, comprising:

said seal member having a first dimensional configuration in its elastic state and a reduced second dimensional configuration in its inelastic state, means maintaining said seal member under compression in its elastic and inelastic state;

the first configuration being sufficient, in relation to the second dimensional configuration and to the dimensional configuration of the first material at the temperature producing said inelastic state, to impart to said second material forces which do not exceed ultimate tensile forces at a selected cryogenic temperature.

6. In a cryogenic seal for a connector including a shell means having an internal chamber and connector means in said chamber the provision of:

an elastomeric seal member extending between surfaces of said chamber and of said connector means, said seal member having an elastic state and an inelastic state in which said material is fracturable when subjected to low tensile forces at cryogenic temperatures, said elastomeric seal member, said shell means, and connector means having different coefficients of thermal expansion;

said elastomeric seal member having dimensions at ambient temperatures selected with reference to the different coefficients of expansion and contraction of materials of the seal member and of said shell means and connector means;

said selected dimensions of said seal member being oversized a selected amount;

said oversized dimension being reduced at cryogenic temperatures;

the relative contraction at cryogenic temperatures of said seal member, shell means, and connector means occurring without imposing tension forces on said seal member in excess of its elastic limit at cryogenic temperatures;

said dimensions of said elastomeric seal member at ambient temperature being in the order of 6% greater than the dimensions of said elastomeric member at its inelastic state.

7. In a cryogenic seal for a connector including a shell means having an internal chamber and connector means in said chamber, the provision of:

an elastomeric seal member extending between surfaces of said chamber and of said connector means, said seal member having an elastic state and an inelastic state in which said material is fracturable when subjected to low tensile forces at cryogenic temperatures, said elastomeric seal member, said shell means, and connector means having different coefficients of thermal expansion;

said elastomeric seal member having dimensions at ambient temperatures selected with reference to the different coefficients of expansion and contraction of materials of the seal member and of said shell means and connector means;

said selected dimensions of said seal member being oversized a selected amount;

said oversized dimension being reduced at cryogenic temperatures;

the relative contraction at cryogenic temperatures of said seal member, shell means, and connector means occurring without imposing tension forces on said seal member in excess of its elastic limit at cryogenic temperatures;

said shell means including a central axis;

said connector means includes contact members spaced a radial distance from said central axis, each contact member having a diameter;

said seal member includes an axis coinciding with the central axis of the shell means;

said seal member having holes to receive said contact members, the axes of said holes being spaced radially from the axes of said contact members and the diameter of said holes being greater than the diameter of said contact members;

the difference in radial spacing of said axes and the diameters of said holes and contact members being directly related to the coefficients of thermal expansion of said elastomeric seal member and said shell means, whereby at selected cryogenic operating temperature the axes of said holes and the axes of said contact members coincide and the holes substantially uniformly receive said contact members.

8. In a method of providing a seal at cryogenic temperatures between a first material and a second material, said materials having different coefficients of thermal expansion, said second material having an inelastic state over a certain range of cryogenic temperatures, comprising the steps of:

sizing said first material at ambient temperature in a selected first shape;

and sizing said second material at ambient temperature in a second selected shape with respect to said first shape;

arranging said shapes about a common axis, said second shape being dimensioned with reference to the differences of said coefficients of expansion of said materials, said second material being inelastic at a selected cryogenic temperature and being in a contracted condition relative to said first material, said second shape being not subject to forces exceeding the elastic limit of said second material at the selected cryogenic temperature;

said step of sizing said first material including:

establishing a central axis and locating electrical contact members radially spaced with respect thereto, and the step of sizing said second material includes locating holes for said contact members, the axes of said holes being radially spaced from the axes of respective contact members and the diameters of the holes being greater than the diameters of the contact members, the differences in radial spacing and hole diameter being related to the difference in coefficient of expansion of said materials.

* * * * *